US010125754B2

(12) United States Patent
Ahn et al.

(10) Patent No.: US 10,125,754 B2
(45) Date of Patent: Nov. 13, 2018

(54) RECIPROCATING COMPRESSOR HAVING CASING INCLUDING INNER AND OUTER SHELLS

(71) Applicant: LG ELECTRONICS INC., Seoul (KR)

(72) Inventors: Kwangwoon Ahn, Seoul (KR); Kichul Choi, Seoul (KR); Donghan Kim, Seoul (KR); Sunghyun Ki, Seoul (KR); Kyeongbae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 498 days.

(21) Appl. No.: 14/747,110

(22) Filed: Jun. 23, 2015

(65) Prior Publication Data

US 2015/0285235 A1 Oct. 8, 2015

Related U.S. Application Data

(62) Division of application No. 13/973,043, filed on Aug. 22, 2013, now Pat. No. 9,494,148.

(30) Foreign Application Priority Data

Aug. 24, 2012 (KR) ..... 10-2012-0093277
Sep. 3, 2012 (KR) ..... 10-2012-0097277
(Continued)

(51) Int. Cl.
*F04B 35/04* (2006.01)
*F01B 1/00* (2006.01)
(Continued)

(52) U.S. Cl.
CPC ..... *F04B 35/04* (2013.01); *F01B 1/00* (2013.01); *F04B 35/045* (2013.01);
(Continued)

(58) Field of Classification Search
CPC ..... F04B 35/045; F04B 39/12; F04B 39/122; F04B 35/04; F04B 39/123; F04B 39/0276;
(Continued)

(56) References Cited

U.S. PATENT DOCUMENTS 2,916,332 A 12/1959 Pavlecka
4,873,913 A 10/1989 Pruitt et al.
(Continued)

FOREIGN PATENT DOCUMENTS

CN 1372077 A 10/2002
CN 1483936 A 3/2004
(Continued)

OTHER PUBLICATIONS

Chinese Office Action issued in Application No. 201310375841.6 dated Jun. 30, 2015.
(Continued)

*Primary Examiner* — Dominick L Plakkoottam
*Assistant Examiner* — Stephen Mick
(74) *Attorney, Agent, or Firm* — KED & Associates LLP

(57) ABSTRACT

A reciprocating compressor is provided. Bearing holes of a fluid bearing of the compressor may be positioned to correspond to a full reciprocating region of a piston, to reduce/eliminate frictional loss and/or abrasion between a cylinder and the piston. The bearing holes may be concentrated at certain regions of the cylinder to stably support the piston through a full reciprocating range. Compression coil springs may maintain concentric alignment of the cylinder and the piston. Gas through holes may be radially formed at the piston to lower a pressure of a bearing space and allow refrigerant to be smoothly introduced into the bearing space through a gas pocket A casing of the compressor may include an outer shell and an inner shell to attenuate vibra-
(Continued)

tion generated due to friction generated by operation of the reciprocating compressor.

3 Claims, 18 Drawing Sheets

(30) Foreign Application Priority Data

Sep. 19, 2012 (KR) ..... 10-2012-0104151
Apr. 1, 2013 (KR) ..... 10-2013-0035350

(51) Int. Cl.
*F04B 39/12* (2006.01)
*F04B 39/00* (2006.01)
*F04B 39/02* (2006.01)

(52) U.S. Cl.
CPC ..... *F04B 39/0005* (2013.01); *F04B 39/0276* (2013.01); *F04B 39/12* (2013.01); *F04B 39/121* (2013.01); *F04B 39/122* (2013.01); *F04B 39/123* (2013.01)

(58) Field of Classification Search
CPC .... F04B 39/0005; F04B 39/121; F16C 32/06; F16C 32/0662; F16C 35/078; F16C 37/002; F01B 1/00
USPC ..... 417/417
See application file for complete search history.

(56) References Cited

U.S. PATENT DOCUMENTS

| | | | | |
|---|---|---|---|---|
| 5,993,178 | A | 11/1999 | Park et al. | |
| 6,491,506 | B1 | 12/2002 | Oh et al. | |
| 7,150,605 | B2 | 12/2006 | Kim et al. | |
| 7,913,613 | B2 | 3/2011 | Muth et al. | |
| 2006/0093495 | A1* | 5/2006 | Oh | F04B 35/045 417/417 |
| 2006/0239843 | A1* | 10/2006 | Iguchi | F01C 21/10 417/410.5 |
| 2008/0118375 | A1* | 5/2008 | Muth | F02G 1/0435 417/363 |
| 2009/0238701 | A1 | 9/2009 | Giacchi et al. | |
| 2010/0046866 | A1 | 2/2010 | Schubert | |
| 2010/0247308 | A1* | 9/2010 | Giacchi | B23K 26/0626 415/229 |
| 2010/0316513 | A1* | 12/2010 | Lee | F04B 39/14 417/417 |
| 2012/0251358 | A1* | 10/2012 | Ota | F01C 21/10 417/410.5 |

FOREIGN PATENT DOCUMENTS

| | | | |
|---|---|---|---|
| CN | 1566686 | A | 1/2005 |
| CN | 101091043 | A | 12/2007 |
| DE | 10 2004 061940 | A1 | 7/2006 |
| DE | 10 2006 052430 | A1 | 5/2008 |
| DE | 10 2008 007661 | A1 | 8/2009 |
| DE | 10 2012 104163 | B3 | 8/2013 |
| GB | 923732 | A | 4/1963 |
| JP | 2001227461 | A | 8/2001 |
| JP | 2004332651 | A | 11/2004 |
| JP | 2005-23880 | A | 1/2005 |
| JP | 2006509962 | A | 3/2006 |
| JP | 3122681 | U | 5/2006 |
| KR | 10-0414116 | | 12/2003 |
| KR | 10-0548292 | | 1/2006 |
| KR | 10-2007-0086475 | | 8/2007 |
| SU | 1 525 313 | A1 | 11/1989 |
| WO | WO 01/029444 | A1 | 4/2001 |
| WO | WO 2004/089320 | | 10/2004 |

OTHER PUBLICATIONS

U.S. Final Office Action dated Jul. 17, 2015 issued in co-pending U.S. Appl. No. 13/973,043.
Korean Notice of Allowance dated Oct. 21, 2013 for corresponding Korean Application No. 10-2012-0093277.
Korean Office Action dated Oct. 23, 2013 for corresponding Korean Application No. 10-2012-0104151.
European Search Report issued in Application No. 13180403.1 dated Jan. 7, 2014.
Korean Notice of Allowance dated Oct. 6, 2014, issued in Application No. 10-2012-0104151.
U.S. Office Action issued in parent U.S. Appl. No. 13/973,043 dated Jan. 16, 2015.
Korean Office Action dated Apr. 27, 2018.

* cited by examiner

RECIPROCATING COMPRESSOR HAVING CASING INCLUDING INNER AND OUTER SHELLS

CROSS-REFERENCE TO RELATED APPLICATION(S)

This application is a Divisional Application of U.S. patent application Ser. No. 13/973,043, filed Aug. 22, 2013, which claims priority under 35 U.S.C. § 119 to Korean Application No. Korean Application No. 10-2012-0093277 filed on Aug. 24, 2012, Korean Application No. 10-2012-0097277 filed on Sep. 3, 2012, Korean Application No. 10-2012-0104151 filed on Sep. 19, 2012, and Korean Application No. 10-2013-0035350 filed on Apr. 1, 2013, whose entire disclosures are hereby incorporated by reference.

BACKGROUND

1. Field

This relates to a reciprocating compressor, and particularly, to a reciprocating compressor having a fluid bearing.

2. Background

A reciprocating compressor may suction in a refrigerant, and then compress and discharge the refrigerant as a piston performs a linear reciprocating motion in a cylinder. Reciprocating compressors may be categorized as connection type compressors or vibration type compressors depending on a driving method of the piston. In a connection type reciprocating compressor, refrigerant is compressed as a piston performs a reciprocating motion in a cylinder in a connected state to a rotation shaft of a rotation motor by a connecting rod. In a vibration type reciprocating compressor, refrigerant is compressed as a piston performs a reciprocating motion in a cylinder while vibrating in a connected state to a mover of a reciprocating motor.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of exemplary embodiments, with reference to the accompanying drawings. For the sake of brief description with reference to the drawings, the same or equivalent components will be provided with the same reference numbers, and description thereof will not be repeated.

Performance of a reciprocating compressor may be enhanced when a lubricating operation is performed in a state in which a space between the cylinder and the piston is as well sealed as possible. To this end, oil may be supplied to a space between the cylinder and the piston and form an oil film so that the space between the cylinder and the piston may be sealed, and a lubricating operation may be performed. However, in this case, an additional oil supply device may be used to supply of a lubricant, and a lack of oil may occur depending on a particular driving condition during oil supply, which may impact performance of the reciprocating compressor. Additionally, a size of the reciprocating compressor may be increased to accommodate a prescribed amount of oil for such an oil supply operation. Further, an installation direction of the reciprocating compressor may be somewhat limited to provide for a proper amount of oil at an inlet into the oil supply device.

Figure 1:
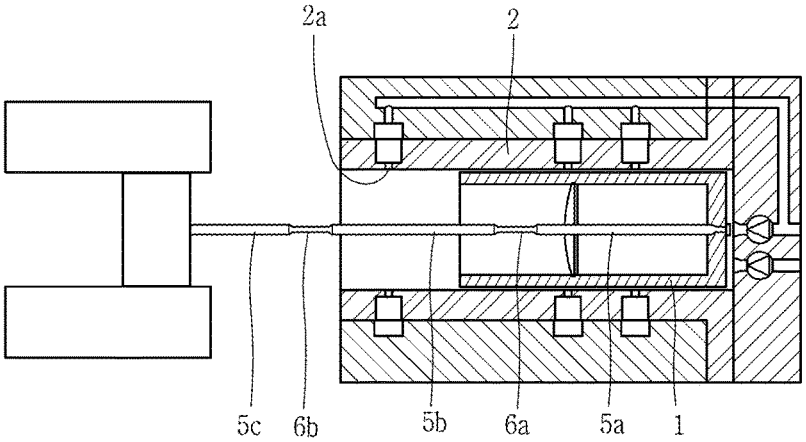
FIG. 1 RELATED ART
FIG. 1 is a longitudinal sectional view of an exemplary gas bearing applied to a reciprocating compressor.

To address these issues, as shown in FIG. 1, a fluid bearing may be formed between the piston 1 and the cylinder 2. In order to inject compression gas to an inner circumferential surface of the cylinder 2, a plurality of bearing holes 2*a* of a relatively small diameter may penetrate the cylinder 2. This may eliminate the need for a separate oil supply device to supply oil to a space between the piston 1 and the cylinder 2, simplify a lubricating structure for the reciprocating compressor, and prevent oil deficiency during certain driving conditions, thus maintaining desired performance of the reciprocating compressor. This may also eliminate the need for a space for accommodating oil.

However, as shown in FIG. 1, when the piston 1 reaches a top dead point, i.e., a position where a capacity of a compression space of the cylinder 2 is minimized, a rear region of the piston 1 in a lengthwise direction is out of the range of bearing holes 2*a*. On the other hand, when the piston 1 reaches a bottom dead point, a front region of the piston 1 in a lengthwise direction is out of the range of bearing holes 2*a*. As a result, the front region or the rear region of the piston 1 is not always stably supported while the piston 1 performs a reciprocating motion. Further, in a case in which gas is injected into a compression space from the bearing holes 2*a* which are out of the range of the piston 1, a specific volume of a refrigerant sucked into the compression space may be increased. On the other hand, in a case in which gas is injected to the rear region of the piston 1, a backward motion of the piston 1 may not be smoothly performed. It may be difficult and/or costly to design and fabricate the bearing holes such that gas cannot be injected into the bearing holes 2*a* which are out of the range of the piston 1, thus increasing cost and lowering reliability of the compressor.

Figure 2:
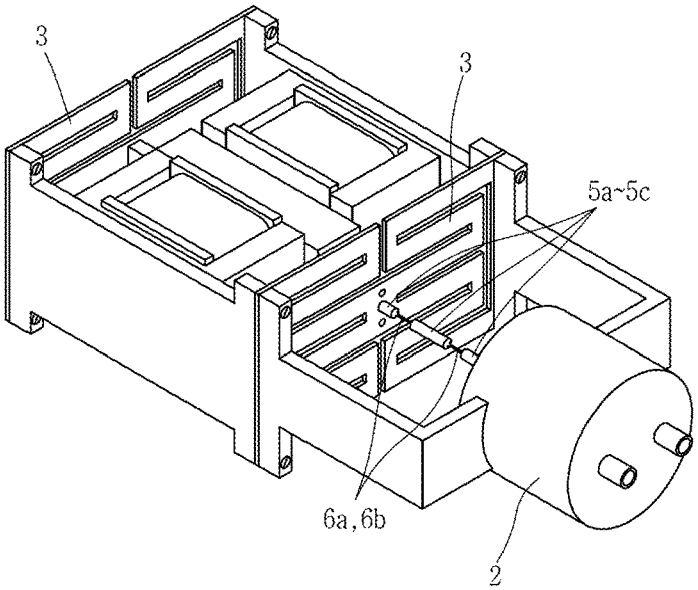
FIG. 2 RELATED ART
FIG. 2 is a longitudinal sectional view of an exemplary plate spring applied to a reciprocating compressor.

In a case in which a fluid bearing is applied to a reciprocating compressor, the piston 1 may supported in a radial direction by a plate spring 3, as shown in FIG. 2. However, as a transformation of the piston 1 (refer to FIG. 1) in a direction perpendicular to a lengthwise direction (horizontal transformation) is scarcely generated due to characteristics of the plate spring 3, it may be difficult to assemble the piston 1 and the cylinder 2 in a concentric manner. This may cause misalignment of the piston 1 and the cylinder 2, resulting in abrasion and frictional loss. Accordingly, when using the plate spring 3, the piston 1 and the plate spring 3 may be connected to each other by a flexible connecting bar, or by one or more links 6*a*~6*b* configured to connect a plurality of connecting bars 5*a*~5*c*. However, this may increase fabrication costs. Further, the plate spring 3 may be damaged as a stress is accumulated at a notch portion of the plate spring 3 because a transformation of the piston 1 in a lengthwise direction (vertical transformation) is relatively great. This may cause a limitation in a stroke of the piston 1, and/or may lower reliability of the piston 1.

In a case in which a fluid bearing is applied to the reciprocating compressor, a pressure inside the compression space is gradually increased as the piston 1 moves to a top dead point from a bottom dead point. The pressure inside the compression space becomes almost equal to a bearing pressure. Accordingly, gas may not be smoothly supplied to the bearing holes 2 which constitute the fluid bearing. As a result, a bearing function may be degraded. Further, external vibrations applied to a shell or vibrations generated from inside of the shell are attenuated only by supporting springs. This may cause vibration noise to be insufficiently attenuated.

Figure 3:
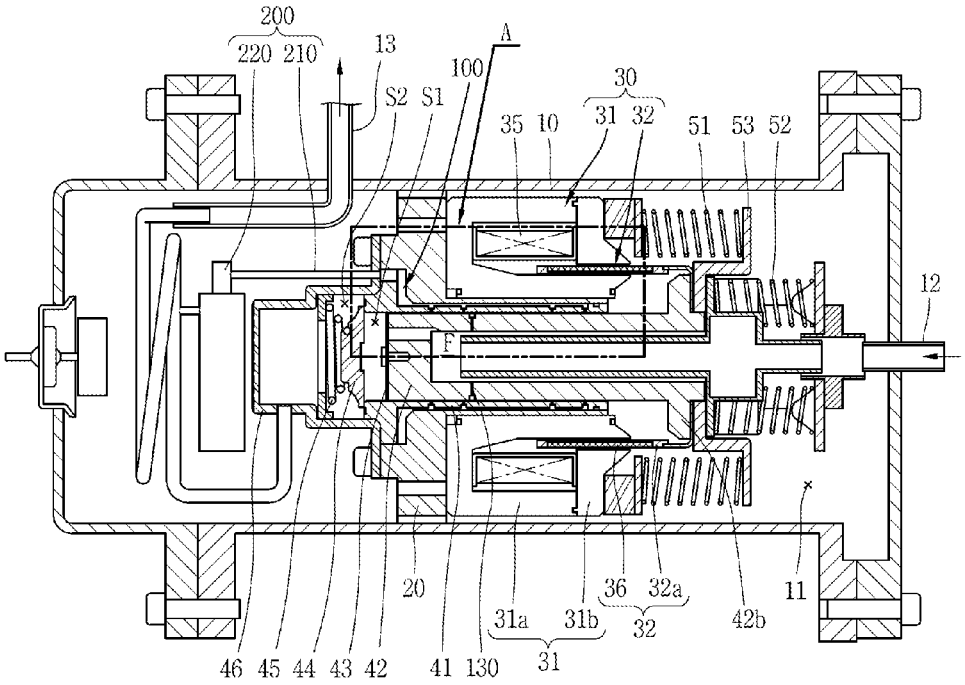
FIG. 3 is a longitudinal sectional view of a reciprocating compressor as embodied and broadly described herein.

FIG. 3 is a longitudinal sectional view of a reciprocating compressor as embodied and broadly described herein.

As shown in FIG. 3, the reciprocating compressor may include a suction pipe 12 connected to an inner space 11 of a casing 10, and a discharge pipe 13 connected to a discharge space (S2) of a discharge cover 46.

A frame 20 may be installed at the inner space 11 of the casing 10, and a stator 31 of a reciprocating motor 30 and a cylinder 41 may be fixed to the frame 20. A piston 42 coupled to a mover 32 of the reciprocating motor 30 may be inserted into the cylinder 41 so as to perform a reciprocating motion. Resonant springs 51 and 52 for inducing a resonant motion of the piston 42 may be installed at two sides of the piston 42 in a reciprocating direction.

A compression space (S1) may be formed at the cylinder 41, a suction channel (F) may be formed at the piston 42, and a suction valve 43 for opening and closing the suction channel (F) may be installed at the end of the suction channel (F). A discharge valve 44 for opening and closing the compression space (S1) of the cylinder 41 may be installed at the front end of the cylinder 41.

In such a reciprocating compressor, once power is supplied to the reciprocating motor 30, the mover 32 of the reciprocating motor 30 performs a reciprocating motion with respect to the stator 31. Then, the piston 42 coupled to the mover 32 performs a linear reciprocating motion in the cylinder 41, thereby sucking a refrigerant in, compressing the refrigerant, and then discharging the compressed refrigerant.

If the piston 42 is moved backward, a refrigerant inside the casing 10 is sucked to the compression space (S1) through the suction channel (F) of the piston 42. On the other hand, if the piston 42 is moved forward, the refrigerant compressed in the compression space (S1) is discharged as the discharge valve 44 is open, to thus be provided to an external refrigerating cycle.

A coil 35 may be insertion-coupled into the stator 31 of the reciprocating motor 30, and an air gap may be formed at one side of the stator 31 based on the coil 35. A magnet 36, which performs a reciprocating motion in a moving direction of the piston 42, may be provided at the mover 32.

The stator 31 may include a plurality of stator blocks 31*a*, and a plurality of pole blocks 31*b* coupled to one side of the stator blocks 31*a* and forming an air gap portion 31*c* together with the stator blocks 31*a*. The stator blocks 31*a* and the pole blocks 31*b* may be formed in a circular arc shape when projected in an axial direction, as a plurality of thin stator cores are laminated on each other. The stator blocks 31*a* may be formed in a '□' shape when projected in an axial direction, and the stator blocks 31*b* may be formed in a rectangular shape when projected in an axial direction.

The mover 32 may include a magnet holder 32*a* formed in a cylindrical shape, and a plurality of magnets 36 coupled to an outer circumferential surface of the magnet holder 32*a* in a circumferential direction, and forming a magnetic flux together with the coil 35.

To prevent leakage of a magnetic flux, the magnet holder 32*a* may be formed of a non-magnetic substance. However, embodiments are not limited to this. An outer circumferential surface of the magnet holder 32*a* may be formed in a circular shape so that the magnets 36 may be attached thereto in a linear-contacting manner. Magnet mounting grooves configured to support the magnets 36 inserted therein in a moving direction may be formed, in a belt shape, on the outer circumferential surface of the magnet holder 32*a*. Other arrangements may also be appropriate.

In certain embodiments, the magnets 36 may be formed in a hexahedron shape, and may be individually attached to the outer circumferential surface of the magnet holder 32*a*. In a case where the magnets 36 are individually attached to the outer circumferential surface of the magnet holder 32*a*, a supporting member, such as an additional fixing ring or a tape formed of a composite material, may be mounted to an outer circumferential surface of the respective magnets 36 in an enclosing manner for fixation of the magnets 36.

The magnets 36 may be consecutively attached onto the outer circumferential surface of the magnet holder 32*a* in a circumferential direction. However, the stator 31 may include a plurality of stator blocks 31*a* arranged in a circumferential direction with a prescribed interval therebetween. Therefore, for a minimized usage amount of the magnets, the magnets 36 may be attached onto the outer circumferential surface of the magnet holder 32*a* in a circumferential direction, with a prescribed interval therebetween, i.e., an interval between the stator blocks 31*a*.

The magnets 36 may be formed so that their length in a moving direction is greater than that of the air gap 31*c*. For a stable reciprocating motion, the magnets 36 may be arranged so that at least one end thereof in a moving direction may be positioned in the air gap 31*c*, in a state of an initial position or during a driving operation.

In certain embodiments, this arrangement may include one magnet 36. However, in alternative embodiments, this arrangement may include a plurality of magnets 36. The magnets 36 may be arranged so that an N pole and an S pole correspond to each other in a moving direction.

In the reciprocating motor 30, the stator 31 may have one air gap 31*c*. However, in some cases, the stator 31 may have air gap portions at two sides of the stator 31 based on the coil 35. In this case, the mover 32 may be formed in the same manner as in the aforementioned embodiment.

Reduced frictional loss between the cylinder 41 and the piston 42 may enhance performance of the reciprocating compressor. For this, a fluid bearing, which lubricates a space between the cylinder 41 and the piston 42 using a gas force by bypassing part of compression gas to a space between an inner circumferential surface of the cylinder 41 and an outer circumferential surface of the piston 42, may be provided.

Figure 4:
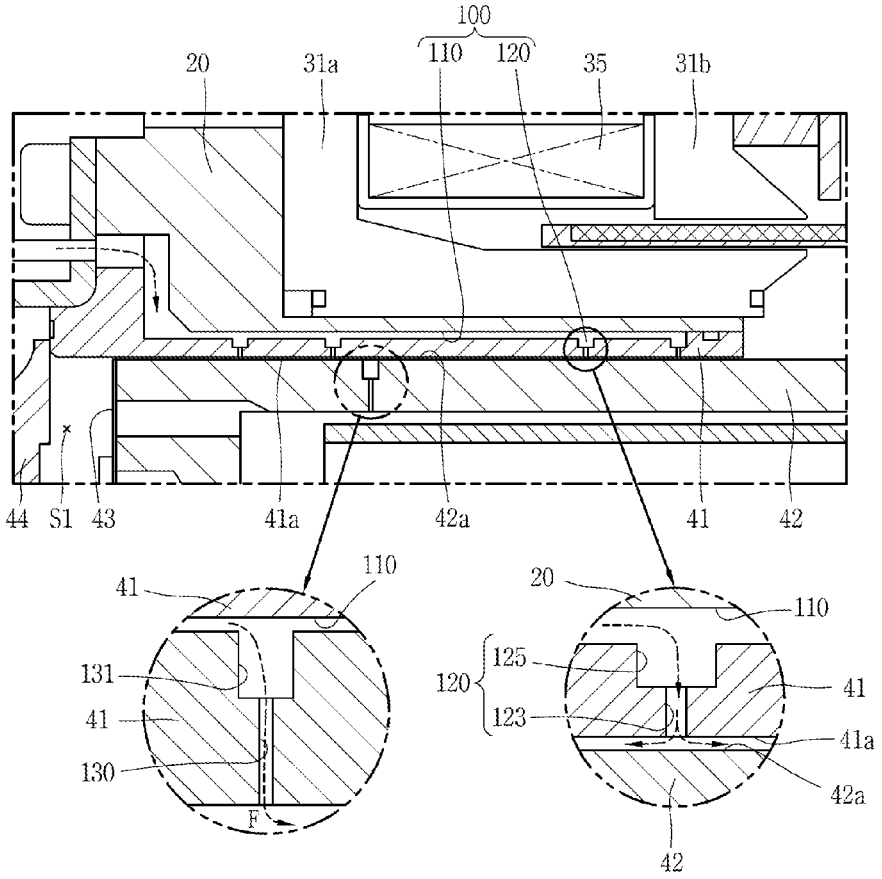
FIG. 4 is an enlarged sectional view of part 'A' in FIG. 3, including a fluid bearing in accordance with an embodiment as broadly described herein.

FIG. 4 is an enlarged sectional view of part 'A' in FIG. 3, which illustrates an embodiment of a fluid bearing. As shown in FIGS. 3 and 4, a fluid bearing 100 may comprise a gas pocket 110 concaved from an inner circumferential surface of the frame 20; plural rows of bearing holes 120 communicated with the gas pocket 110 and penetratingly-formed at an inner circumferential surface of the cylinder 41; and gas through holes 130 penetrating an outer circumferential surface of the piston 42 and positioned corresponding to the suction channel (F). The bearing holes 120 of the same row indicate bearing holes 120 formed on the same circumference of the cylinder 41, positioned the same distance from the front end of the cylinder 41 in a lengthwise direction.

The gas pocket 110 may be formed in a ring shape, on an entire inner circumferential surface of the frame 20. However, in some cases, the gas pocket 110 may be formed in plurality with prescribed intervals therebetween, in a circumferential direction of the frame 20.

A gas guiding portion 200 may be coupled to an inlet of the gas pocket 110 to guide part of compression gas discharged to the discharge space (S2) from the compression space (S1) to the fluid bearing 100. The gas guiding portion 200 may include a gas guiding pipe 210 configured to connect the discharge space (S2) of the discharge cover 46 connected to an intermediate part of the discharge pipe 13 or coupled to the front end of the cylinder 41, to the entrance of the gas pocket 110, and a filter 220 installed at the gas guiding pipe 210 and configured to filter foreign materials from refrigerant gas introduced into the fluid bearing 100.

The gas pocket 110 may be formed between the frame 20 and the cylinder 41. However, in some cases, the gas pocket 110 may be formed in the cylinder 41, i.e., the front end of the cylinder 41, in a lengthwise direction. In this case, the gas guiding portion may be eliminated because the gas pocket 110 is directly communicated with the discharge space (S2) of the discharge cover 46, thus simplifying assembly processes and reducing fabrication costs.

Figure 5:
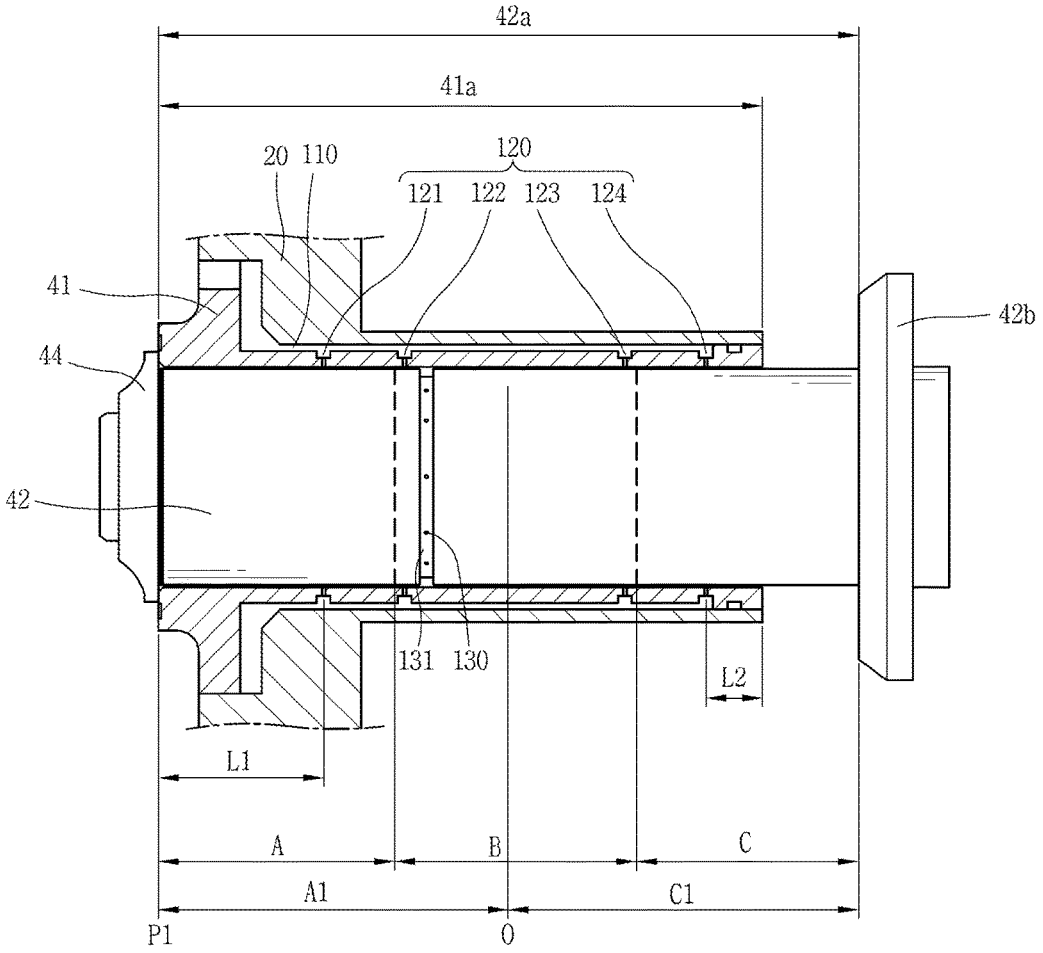
FIGS. 5 and 6 illustrate positions of bearing holes of the fluid bearing shown in FIG. 3.
Figure 6:
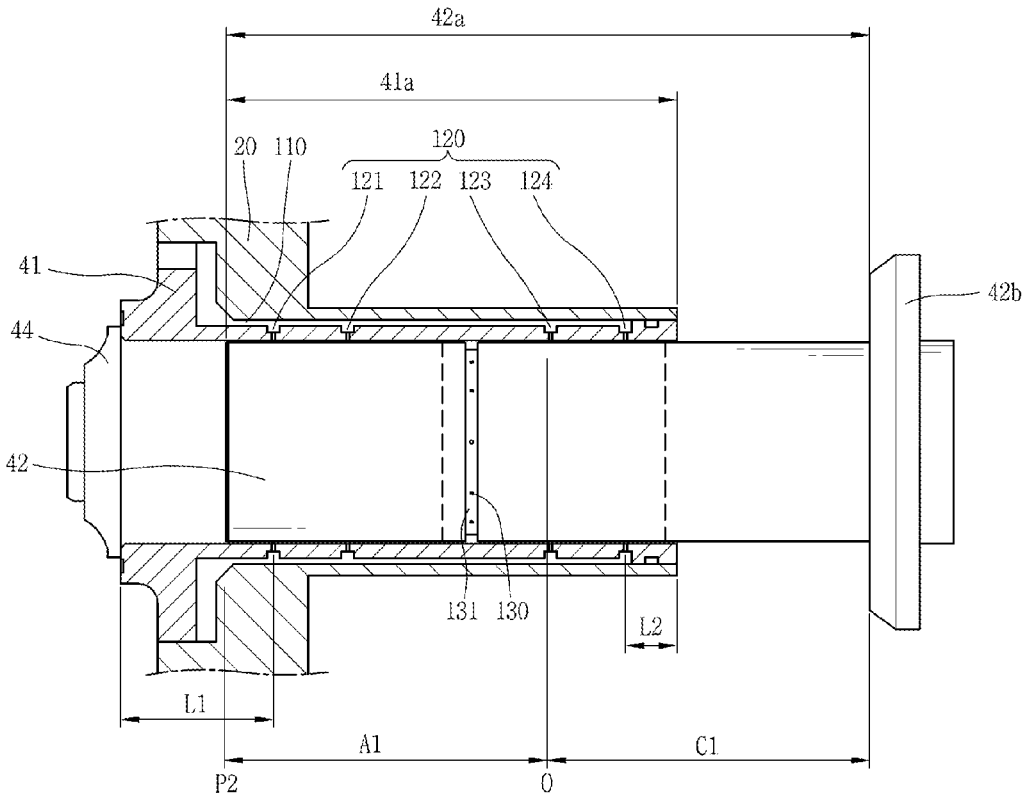

FIGS. 5 and 6 illustrate positions of bearing holes in a reciprocating compressor including a fluid bearing, as embodied and broadly described herein. The bearing holes 120 may each be continuously formed along the inner circumferential surface of the cylinder 41 (hereinafter, will be referred to as 'cylinder side bearing surface'), with a prescribed interval therebetween, in a lengthwise direction of the piston 42.

For instance, in a case where an outer circumferential surface 42*a* of the piston 42 (hereinafter, will be referred to as 'piston side bearing surface') is divided into a front region (A), an intermediate region (B) and a rear region (C) in a lengthwise direction of the piston 42, the bearing holes 120 may be formed so that one row of bearing holes 120 is formed at the front region (A) of the piston side bearing surface 42*a*, and two rows of bearing holes 120 is formed at the intermediate region (B). However, considering that the length of the piston 42 may be longer than that of the cylinder 41, such arrangement may not necessarily support the rear region (C) stably.

Accordingly, as shown in FIG. 5, at least one row of bearing holes may be formed at the rear region (C) in order to support the piston 42 more stably. For example, the bearing holes may be formed at a front region (A1) and a rear region (C1) based on an intermediate position (O) of the piston side bearing surface 42*a* in a lengthwise direction, so as to have the same number and the same total sectional area.

More specifically, bearing holes 121 formed at the front region (A) may be the same as bearing holes 124 formed at the rear region (C) in number and total sectional surface. For instance, if four rows of bearing holes are formed, from the front end to the rear end of the piston 42, the number of first-row bearing holes 121, second-row bearing holes 122, third-row bearing holes 123 and fourth-row bearing holes 124 may be eight, and the bearing holes 121, 122, 123 and 124 may have the same total sectional area. That is, in certain embodiments, the sectional area of the first row bearing holes 121 may be equal to that of the second row bearing holes 122, which may also be equal to that of the third row bearing holes 123, which may also be equal to that of the fourth row bearing holes 124.

The piston side bearing surface 42*a* may be defined as a distance from a front surface of the piston 42, i.e., the front end of the piston 42 where the suction valve 43 is installed, to a flange 42*b* formed at a rear surface of the piston 42 so as to be coupled to the mover 32 and to be supported by the resonant springs 51 and 52. Alternatively, the piston side bearing surface 42*a* may be defined as an outer circumferential surface of the piston 42 which forms a bearing surface together with an inner circumferential surface of the cylinder 41.

In this case, as shown in FIG. 6, the bearing holes 120 may be penetratingly-formed at the cylinder side bearing surface 41*a* so that the first-row bearing holes 121 may be positioned within the range of the cylinder side bearing surface 41*a*, even in a case where the piston 42 moves up to a bottom dead point (hereinafter, will be referred to 'first position' P1). In order to support the piston 42 stably, as shown in FIG. 5, the bearing holes 120 may be formed so that the fourth-row bearing holes 124 may be positioned within the range of the piston side bearing surface 42*a*, even in a case where the piston 42 moves up to a top dead point (hereinafter, will be referred to 'second position' P2) where a capacity of the compression space (S1) is minimized.

As shown in FIGS. 5 and 6, an interval (L1) from the front end of the piston 42 to the first-row bearing holes 121 may be greater than an interval (L2) from the rear end of the piston 42 to the fourth-row bearing holes 124. As the flange 42*b* is formed at the rear end of the piston 42, a relatively large load support capacity is required at the rear end of the piston 42. Considering this, the bearing holes may be formed in a concentrated manner toward the rear end of the piston side bearing surface 42*a*, so that the piston 42 may be supported stably.

The bearing holes in this embodiment may be defined based on the cylinder side bearing surface 41*a*. For instance, as shown in FIG. 5, the cylinder side bearing surface 41*a* may be divided into a front region (A1) and a rear region (C1) in a lengthwise direction of the piston 42. In this case, the bearing holes 121 and 122 may be formed at the front region (A1) of the cylinder side bearing surface 41*a* in two rows, and the bearing holes 123 and 124 may be formed at the rear region (C1) of the cylinder side bearing surface 41*a* in two rows.

For stable support of the piston 42, the bearing holes 121 and 122 formed at the front region (A1) of the cylinder side bearing surface 41*a* based on an intermediate part (O) of the piston 42 in a lengthwise direction, are essentially the same as the bearing holes 123 and 124 formed at the rear region (C1) of the cylinder side bearing surface 41*a*, in number and in respective total sectional area.

In a case where the length of the piston side bearing surface 42*a* is greater than that of the cylinder side bearing surface 41*a* and the reciprocating compressor performs a reciprocating motion in a horizontal direction, the bearing holes 121, 122, 123 and 124, through which gas is injected to a space between the cylinder 41 and the piston 42, are evenly formed not only on the front region (A) and the intermediate region (B) close to the compression space (S1), but also on the rear region (C) of the piston 42. Accordingly, the piston 42 may be stably supported, and frictional loss and/or abrasion occurring between the cylinder 41 and the piston 42 may be prevented.

In a case where resonant springs 51 and 52 for inducing a resonant motion of the piston 42 are implemented as compression coil springs, a downward transformation degree of the piston 42 may be increased because the compression coil springs have a large horizontal transformation. However, in this embodiment, the bearing holes 121, 122, 123 and 124 are formed through the entire regions (A), (B) and (C) of the piston in a lengthwise direction, and are formed at the front end and the rear end each requiring a high load support capacity, in two rows. When so configured, the piston 42 may smoothly perform a reciprocating motion without being transformed downward, and frictional loss and/or abrasion occurring between the cylinder 41 and the piston 42 may be prevented.

Figure 7:
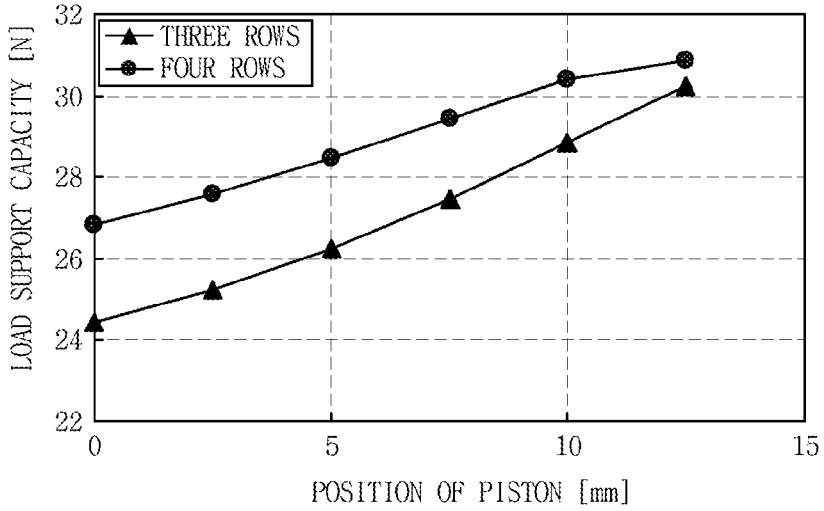
FIGS. 7 and 8 are graphs comparing a load support capacity (N) and a consumption amount (ml/min) according to a position of a piston in a case in which bearing holes of the fluid bearing shown in FIG. 3 are arranged at 4 rows, and a case in which bearing holes are arranged at 3 rows.
Figure 8:
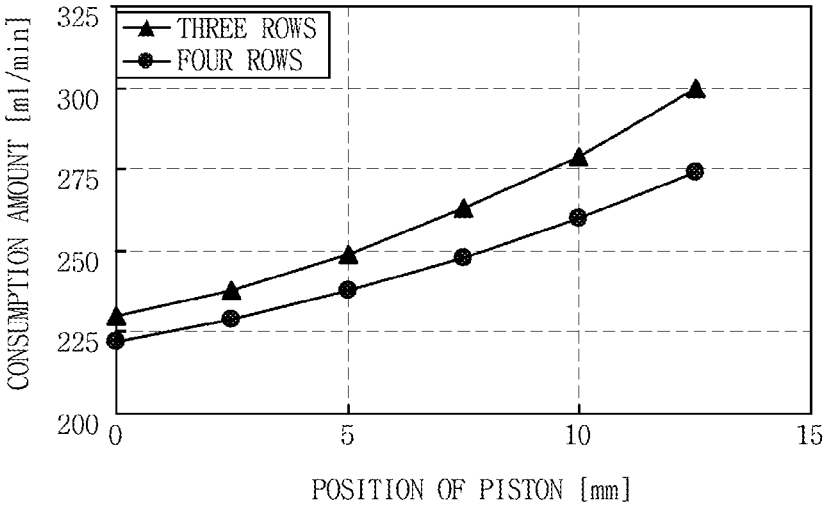

FIGS. 7 and 8 are graphs comparing a load support capacity (N) and a consumption amount (ml/min) according to a position of a piston in a case in which two bearing holes are arranged in 3 rows (i.e., two rows of bearing holes are arranged at a front region and one row of bearing holes are arranged at an intermediate region), with a case in which bearing holes are arranged in 4 rows (i.e., one row of bearing holes are arranged at a front region, two rows of bearing holes are arranged at an intermediate region, and one row of bearing holes are arranged at a rear region) as described above. The number of the bearing holes in each row is the same.

As shown in FIG. 7, a load support capacity in the four row arrangement is always greater than that of the three row arrangement, regardless of a position of the piston. As previously described, plural rows of bearing holes, positioned at the front region or the rear region of the piston, may be out of the range of the piston according to a position of the piston (i.e., a suction stroke or a discharge stroke). As a result, some rows of the bearing holes do not serve as gas bearing, and thus a load support capacity is lowered according to a position of the piston. Especially, the number of bearing holes formed at the rear region of the piston is smaller than that of the bearing holes formed at the front region of the piston, resulting in lowering a load support capacity toward the rear side of the piston.

On the other hand, in a fluid bearing as embodied and broadly described herein, the bearing holes positioned on the entire region of the piston are always within the range of the piston. Accordingly, all the bearing holes serve as a gas bearing regardless of a position of the piston, and thus a load support capacity is increased. The bearing holes 121 of a first row and the bearing holes 122 of a second row are arranged at a front region of the piston 42, whereas the bearing holes 123 of a third row and the bearing holes 124 of a fourth row are arranged at a rear region of the piston 42. This may increase a load support capacity with respect to the piston, and thus allow the piston to be stably supported.

As shown in FIG. 8, a consumption amount of the four row arrangement is less than that of the three row arrangement, regardless of a position of the piston. In the four row arrangement, all the bearing holes on the entire region of the piston are within the range of the piston, and a number of bearing holes is smaller and consumption amount is lower. Further, in the three row arrangement, oil leakage may occur at bearing holes positioned out of the range of the piston, and the number of bearing holes is larger, thus increasing a consumption amount, introducing a larger amount of oil into the compression space, reducing and amount of refrigerant, and lowering cooling performance. Further, as a larger amount of oil leaks to a refrigerating cycle, refrigerating efficiency of the refrigerating cycle may be lowered.

Figure 9:
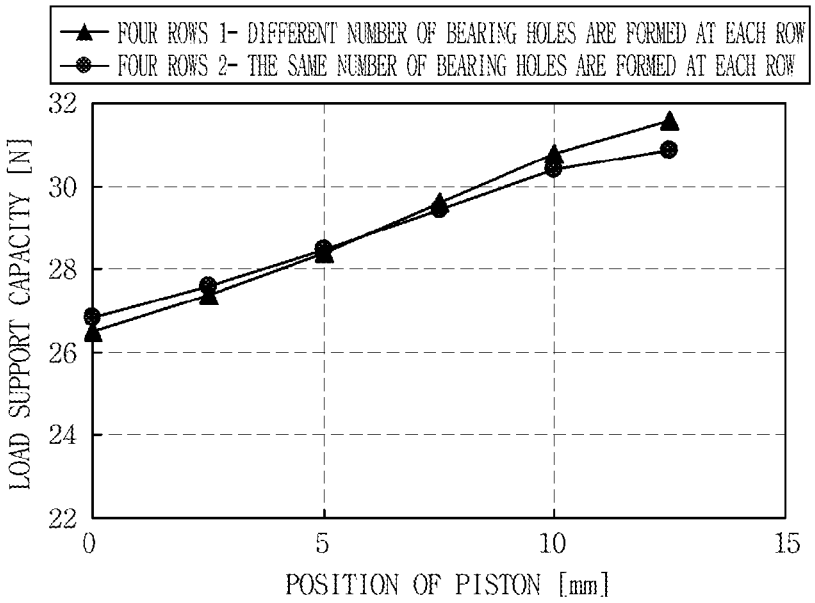
FIGS. 9 and 10 are graphs comparing a load support capacity (N) and a consumption amount (ml/min) according to a position of a piston in a case in which bearing holes of the fluid bearing shown in FIG. 3 are arranged at 4 rows and different number of bearing holes are provided in each row, and a case which the same number of bearing holes are provided in each row.
Figure 10:
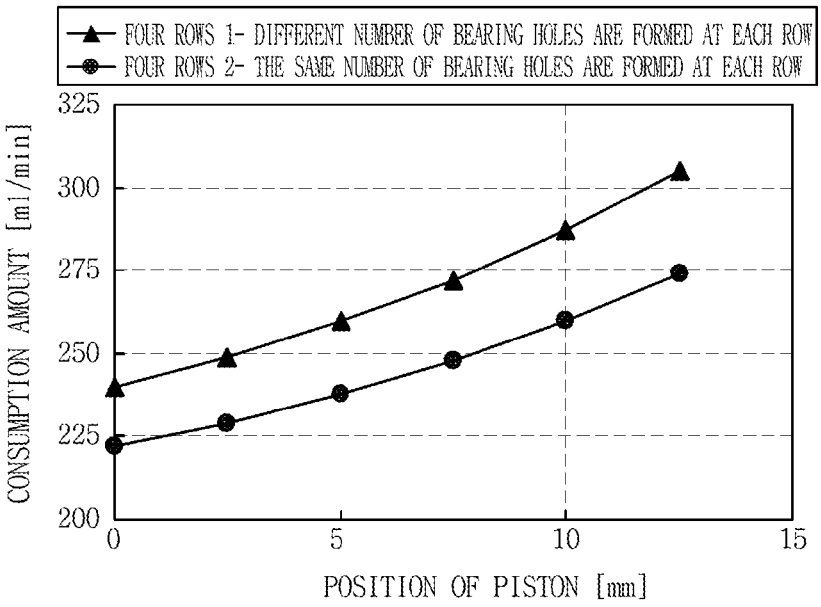

In the reciprocating compressor as embodied and broadly described herein, the numbers of bearing holes arranged at a plurality of rows may be different from each other. FIGS. 9 and 10 are graphs comparing a load support capacity (N) and a consumption amount (ml/min) according to a position of a piston in a case where bearing holes are arranged in 4 rows (i.e., one row of 10 bearing holes formed at a front region, two rows of 8 bearing holes formed at an intermediate region, and one row of 10 bearing holes formed at a rear region), with a case in which the same number of bearing holes are arranged at each region. That is, in the aforementioned embodiment, the same number of bearing holes are formed in each row. However, in this embodiment, the number of bearing holes formed at the front region is 10, the number of bearing holes formed at the intermediate region is 8, and the number of bearing holes formed at the front region is 10.

As shown in FIG. 9, a load support capacity according to this embodiment may be greater, according to a position of the piston. Like in the aforementioned embodiment, the bearing holes on the entire region of the piston are always positioned within the range of the piston, and the bearing holes are formed at two ends of the piston in a concentrated manner. Accordingly, all the bearing holes serve as gas bearing regardless of a position of the piston, and thus a load support capacity may be increased. Especially, when the piston is completely out of the range of the cylinder toward a suction stroke direction, the center of gravity is moved toward the rear side.

However, since the number of bearing holes formed at the rear region of the piston in this embodiment is smaller than that of the aforementioned embodiment, a load support capacity may be increased.

As shown in FIG. 10, a consumption amount according to a position of the piston may be greater because the total number of bearing holes is increased.

In the reciprocating compressor according to this embodiment, if the piston 42 performs a forward motion, a pressure inside the compression space (S1) is gradually increased to become equal to a pressure inside a bearing space (S3), when the discharge valve 44 is open. Considering characteristics of the reciprocating compressor according to this embodiment, a refrigerant compressed in the compression space (S1) is partially introduced into the bearing space (S3) positioned at the front end of the piston 42. Accordingly, no pressure difference occurs between the bearing space (S3) and the gas pocket 110, or the pressure difference is very small. This may cause a refrigerant not to be introduced into the bearing space (S3), and may cause the front end of the piston 42 to be inclined, thereby lowering a performance of the reciprocating compressor.

In order to solve such problems, in this embodiment, gas through holes 130 may be penetratingly—formed at the piston 42 toward an inner circumferential surface from an outer circumferential surface, so that the pressure inside the bearing space (S3) may be lowered. When so configured, refrigerant may be smoothly introduced into the bearing space (S3) through the gas pocket 110.

Figure 11:
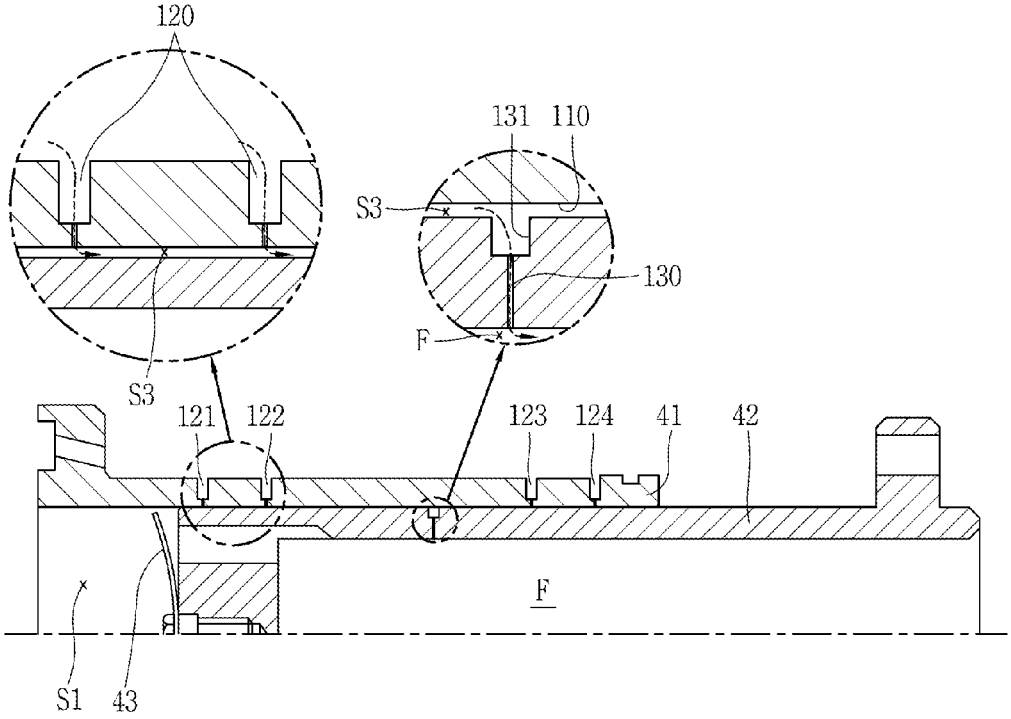
FIGS. 11 and 12 are sectional views illustrating positions of gas through holes provided at a piston in the fluid bearing shown in FIG. 3.
Figure 12:
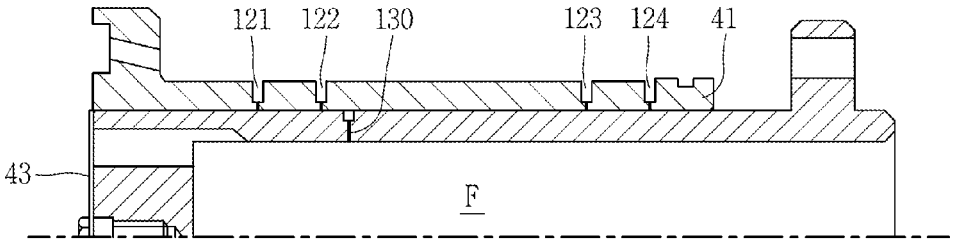

The gas through holes 130 may be formed at any position in communication with the suction channel (F) of the piston 42. However, as shown in FIGS. 11 and 12, if the gas through holes 130 are overlapped with the bearing holes 120 while the piston 42 performs a reciprocating motion, abnormal noise may occur while a refrigerant passes through the bearing holes 120 and the gas through holes 130. In some cases, as the pressure inside the bearing space (S3) is excessively decreased, a refrigerant inside the discharge space (S2) may be excessively introduced into the bearing space (S3), thus lowering performance of the reciprocating compressor.

Accordingly, the gas through holes 130 may be formed between a bottom dead point and a top dead point of the piston 42, the range not overlapped with the bearing holes 120, even if the piston 42 performs a reciprocating motion. More specifically, the gas through holes 130 may be formed between a second row and a third row having a largest interval therebetween, of rows of bearing holes 120. In a case where the cylinder side bearing surface 41*a* is divided into two parts, the second-row bearing holes 122 are positioned at the rearmost side, whereas the third-row bearing holes 123 are positioned at the foremost side.

The gas through holes 130 may be micro through holes which have the same inner diameter from an outer circumferential surface of the piston 42 to an inner circumferential surface. However, in order to smoothly guide gas into the gas through holes 130, a gas guiding groove 131 may be formed on an outer circumferential surface of the piston 42, and the gas through holes 130 may be formed at the gas guiding groove 131. The gas guiding groove 131 may be formed in shape of a single circular belt, in a circumferential direction of the piston 42. In certain embodiments, a plurality of gas guiding grooves 131 may be formed with a prescribed interval therebetween, and the gas through holes 130 may be formed at the gas guiding grooves 131.

In the reciprocating compressor having the gas through holes 130 according to this embodiment, when the piston 42 moves to a top dead point from a bottom dead point as shown in FIG. 12, a pressure inside the compression space (S1) is increased as a volume of the compression space (S1) is gradually decreased. At the same time, part of a refrigerant compressed in the compression space (S1) is introduced to the bearing space (S3) between the cylinder 41 and the piston 42, so that the pressure inside the bearing space (S3) is increased. If the pressure inside the compression space (S1) reaches a prescribed value while the piston 42 moves to the top dead point, the refrigerant is discharged to the discharge space (S2) from the compression space (S1). Then, the refrigerant is partially introduced into a space between the cylinder 41 and the piston 42 through the bearing holes 120, thereby serving as a fluid bearing.

If a pressure of a refrigerant introduced into the bearing space (S3) from the compression space (51) is almost the same as that of a refrigerant introduced to the bearing space (S3) through the bearing holes 120, the refrigerant through the bearing holes 120 is not smoothly introduced into the bearing space (S3). However, in this embodiment, in a case where the gas through holes 130 for communicating the bearing space (S3) with the suction channel (F) are formed at the piston 42, a refrigerant from the bearing space (S3) having a relatively higher pressure, is introduced into the suction channel (F) having a relatively lower pressure. As a result, the pressure inside the bearing space (S3) may be reduced, and refrigerant may be smoothly introduced into the bearing space (S3) through the gas pocket 110 and the bearing holes 120, thus enhancing a bearing effect.

Further, as the gas through holes 130 are formed at a position that does not overlap the bearing holes 120 while the piston 42 performs a reciprocating motion, a relatively large amount of refrigerant may be prevented from rapidly moving toward the suction channel (F). This may prevent the occurrence of abnormal noise, and lowering of efficiency of the reciprocating compressor.

In the aforementioned embodiment, one row of bearing holes are formed at the front region (A), two rows of bearing holes are formed at the intermediate region (B), and one row of bearing holes are formed at the rear region (C), based on the piston side bearing surface 42*a*. Alternatively, two rows of bearing holes 121 and 122 may be formed at the front region (A1), and two rows of bearing holes 123 and 124 may be formed at the rear region (C1), based on the cylinder side bearing surface 41*a*.

In this embodiment, the bearing holes 121, 122, 123 and 124 may be formed with the same interval therebetween, in a lengthwise direction of the cylinder side bearing surface 41*a*. In this case, the bearing holes are always positioned within the range of the piston side bearing surface 42*a* while the piston performs a reciprocating motion, and each row of bearing holes 121, 122, 123 and 124 may include the same number of bearing holes and have the same total sectional area. This may allow the piston 42 to be stably supported.

In this case, the bearing holes 121 of the foremost row (hereinafter, will be referred to as 'first row') are formed within the range of the piston side bearing surface 42*a* even when the piston 42 has moved to a bottom dead point. Also, the bearing holes 124 of the rearmost row (hereinafter, will be referred to as 'fourth row') are formed within the range of the piston side bearing surface 42*a* even when the piston 42 has moved to a top dead point.

The reciprocating compressor according to this embodiment may have similar effects to the reciprocating compressor according to the aforementioned embodiment, and thus duplicate detailed explanations thereof will be omitted. In this embodiment, the bearing holes have the same interval therebetween. Such bearing holes may be easily formed, and thus fabrication costs may be reduced.

In this embodiment, a length of the piston may be greater length than the cylinder, and the resonant springs are implemented as compression coil springs. Due to characteristics of the compression coil springs, the piston may be downward transformed even if the weight of the piston is increased. This may cause a frictional loss or abrasion between the piston and the cylinder. Especially, in a case where gas rather than oil is supplied to a space between the cylinder and the piston for support of the piston, bearing holes arranged at a lower region of the cylinder may have a larger total sectional area than those arranged at an upper region of the cylinder, to prevent downward transformation of the piston. When so configured, frictional loss and/or abrasion occurring between the cylinder and the piston may be prevented.

Figure 13:
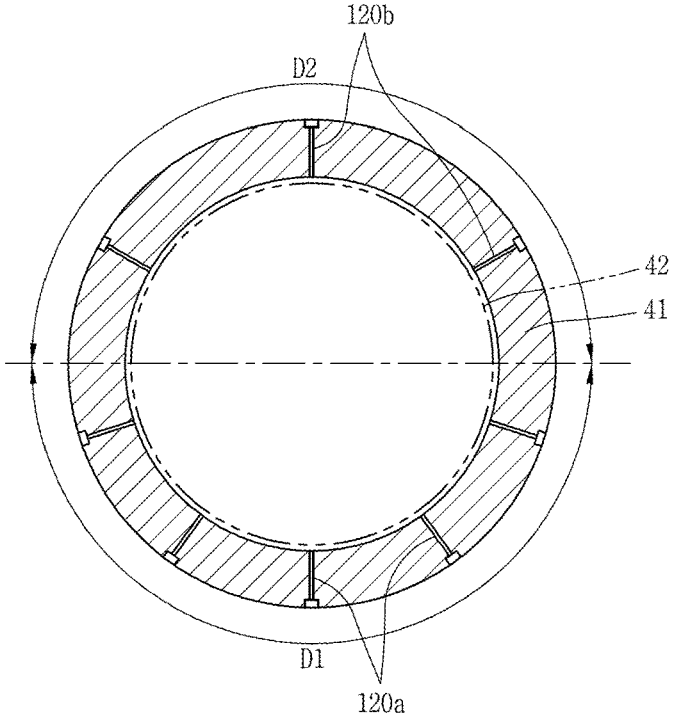
FIGS. 13 to 15 are sectional views illustrating sectional surfaces and numbers of bearing holes at various positions in a fluid bearing provided in a reciprocating compressor, in accordance with embodiments as broadly described herein.
Figure 14:
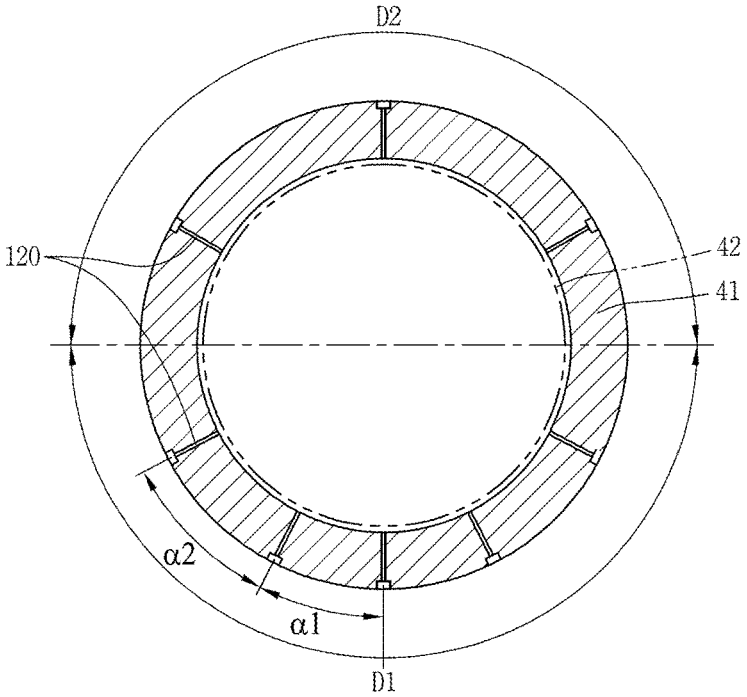
Figure 15:
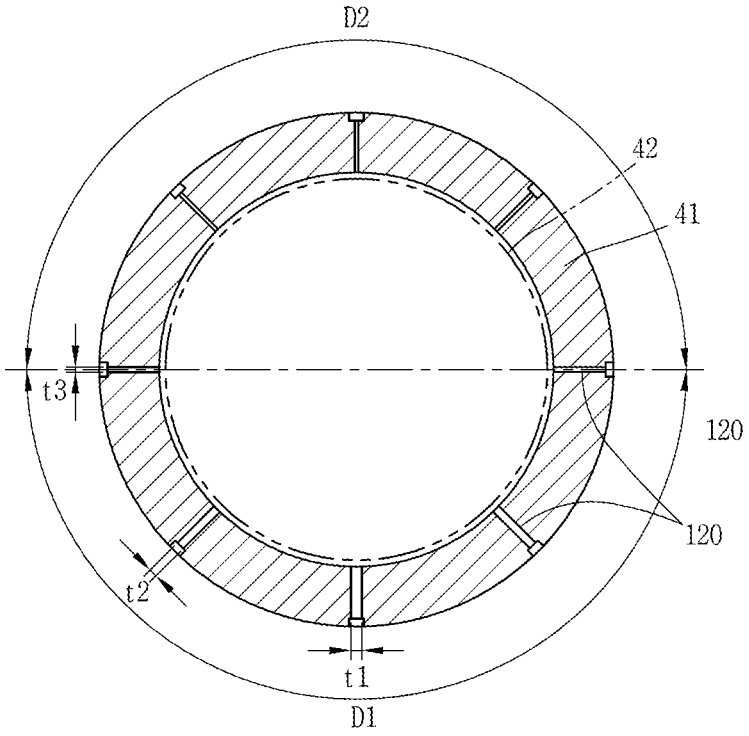

FIGS. 13 to 15 illustrate sectional surfaces and numbers of bearing holes at various positions, in a reciprocating compressor including a fluid bearing, as embodied and broadly described herein.

In this embodiment, bearing holes 120*a* positioned at a lower region (D1) of the cylinder 41 (hereinafter, will be referred to as 'lower side bearing holes 120*a*') may have a larger total sectional area than bearing holes 120*b* positioned at an upper region of the cylinder 41 (hereinafter, will be referred to as 'upper side bearing holes 120*b*').

To this end, as shown in FIG. 13, the number of lower side bearing holes 120*a* may be larger than the number of upper side bearing holes 120*b*. However, if the number of the lower side bearing holes 120*a* is too much larger than that of the upper side bearing holes 120*b*, the piston 42 may be moved upward to contact the upper region D2 of the cylinder 41. Therefore, the number of lower side bearing holes 120*a* and the number of the upper side bearing holes 120*b* may be appropriately controlled. For example, the number of lower side bearing holes 120*a* may be approximately 10-50% larger than that of the upper side bearing holes 120*b*.

As shown in FIG. 14, the bearing holes 120 may be formed so that a number thereof may be gradually increased toward a lowermost point of the cylinder 41 from an uppermost point. That is, an interval between the bearing holes 120 may be narrowed toward a lowermost point of the cylinder 41 from an uppermost point, and thus the number of the bearing holes 120 may be increased toward a lowermost point of the cylinder 41. That is, $\alpha 1<\alpha 2$, as shown in FIG. 14, so that a supporting force with respect to the lower side of the fluid bearing 100 may be increased.

As shown in FIG. 15, the number of lower side bearing holes 120*a* may be the same as that of the upper side bearing holes 120*b*, but a size (i.e., sectional area) (t1) of each lower side bearing hole 120*a* may be larger than a size (t2) of each upper side bearing hole 120*b*. In this case, if the size (t1) of each lower side bearing hole 120*a* is too much larger than the size (t2) of each upper side bearing hole 120*b*, the piston 42 may be moved upward to contact an upper region of the cylinder 41. Therefore, the size (t1) of the lower side bearing hole 120*a* and the size (t2) of the upper side bearing hole 120*b* may be appropriately controlled. For example, the size (t1) of the lower side bearing holes 120*a* may be larger than the size (t2) of the upper side bearing holes 120*b* by about 30~60%.

In this case, the size of the bearing holes 120 may be gradually increased toward the lowermost point of the cylinder 41 from the uppermost point. As the size of the bearing holes 120 is gradually increased toward the lowermost point of the cylinder 41 from the uppermost point, the sectional area of the bearing holes is increased toward the lowermost point of the cylinder 41. When so configured, a supporting force with respect to the lower side of the fluid bearing 100 may be increased.

A gas guiding groove, configured to guide compression gas introduced into the gas pocket into the bearing holes 120, may be formed at an entrance of the bearing holes 120.

Figure 16:
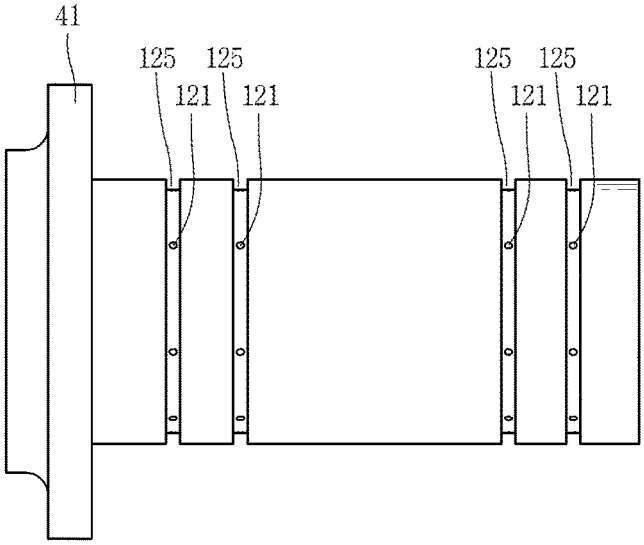
FIGS. 16 to 18 each illustrate bearing holes in a reciprocating compressor, in accordance with embodiments as broadly described herein.
Figure 17:
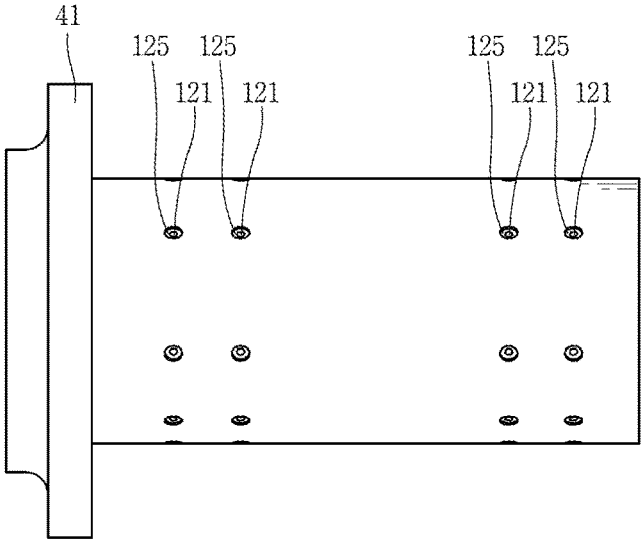
Figure 18:
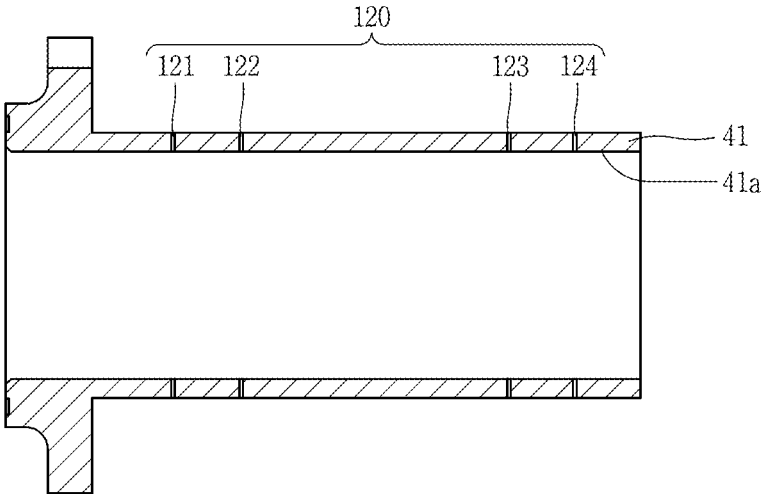

FIGS. 16 to 18 illustrate arrangements of bearing holes according to embodiments as broadly described herein, in a reciprocating compressor to which a fluid bearing is applied.

As shown in FIG. 16, gas guiding grooves 125 may be formed in a ring shape so that the bearing holes 121, 122, 123 and 124 of each row may communicate with each other. However, as shown in FIG. 17, a plurality of gas guiding grooves 126 may be formed in a circumferential direction with a prescribed interval therebetween, so that the plural rows of bearing holes 121, 122, 123 and 124 may be independent from each other.

The gas guiding grooves may be configured so that compression gas introduced into the gas pocket 110 can be injected to a space between the cylinder 41 and the piston 42, so as to serve as a buffer before being injected into the bearing holes 120. To this end, as shown in FIG. 16, the gas guiding grooves 125 may be formed in a ring shape, so that the same pressure may be applied to all the bearing holes of a corresponding row. However, in this case, a region of the cylinder where the gas guiding grooves 125 are formed may have a reduced thickness and thus a somewhat lowered strength. Therefore, as shown in FIG. 17, the gas guiding grooves 126 may be provided in a circumferential direction of the cylinder 41 with a prescribed interval therebetween, so that compression gas may be applied to each of the respective bearing holes with the same pressure. In this arrangement, compression gas may be applied to the respective bearing holes 120 with the same pressure, and the strength of the cylinder may be maintained.

As shown in FIG. 18, the bearing holes 120 may be formed as micro holes so that an outer circumferential end thereof contacting an outer circumferential surface of the cylinder 41 may have the same sectional area as an inner circumferential end thereof contacting an inner circumferential surface of the cylinder 41, without additional gas guiding grooves. Accordingly, the gas pocket 110 may have a larger volume than that of the aforementioned embodiment, so that compression gas may be applied to the respective bearing holes 120 with the same pressure.

In the aforementioned embodiments, the cylinder is inserted into the stator of the reciprocating motor. However, even in a case where the reciprocating motor is mechanically coupled to a compression unit including the cylinder with a prescribed gap therebetween, the aforementioned positions of the bearing holes may be applied in the same manner as in the aforementioned embodiments. Detailed explanations thereof will be omitted.

In the aforementioned embodiments, the piston is configured to perform a reciprocating motion, and the resonant springs are installed at two sides of the piston in a moving direction of the piston. However, in some cases, the cylinder may be configured to perform a reciprocating motion, and the resonant springs may be installed at two sides of the cylinder. In this case, the aforementioned positions of the bearing holes may be applied in the same manner as in the aforementioned embodiments. Detailed explanations thereof will be omitted.

In this embodiment, a length of the piston may be greater length than the cylinder, and the resonant springs may be implemented as compression coil springs. Due to characteristics of the compression coil springs, the piston may be downward transformed even if the weight of the piston is increased. This may cause a frictional loss or abrasion between the piston and the cylinder. Especially, in a case where gas rather than oil is supplied to a space between the cylinder and the piston for support of the piston, the bearing holes may be properly arranged for prevention of downward transformation of the piston. When so configured, frictional loss and/or abrasion occurring between the cylinder and the piston may be reduced/eliminated.

Figure 19:
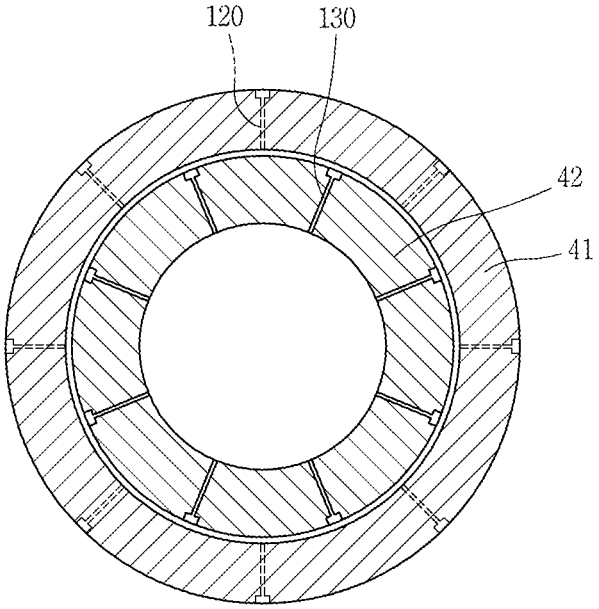
FIG. 19 is a sectional view of another embodiment of an arrangement of bearing holes and gas through holes in the fluid bearing shown in FIG. 3.

The gas through holes 130 may be formed in a circumferential direction of the piston with the same interval therebetween. The gas through holes 130 may be formed at the same distance as the bearing holes 120, from a front end of the cylinder when the piston reaches a top dead point. However, for a large interval between the gas through holes 130 and the bearing holes 120, the gas through holes 130 may be formed at different distances from a front end of the cylinder to the bearing holes 120 when the piston reaches a top dead point. For instance, as shown in FIG. 19, the gas through holes 130 may be formed on a different line from the bearing holes 120 in a radial direction, so that the gas through holes 130 may be positioned among the bearing holes 120 in a circumferential direction when longitudinal sections of the cylinder 41 and the piston 42 are viewed.

In the aforementioned embodiments, the bearing holes are arranged so that their rows disposed at two sides of the intermediate region of the piston may be symmetrical with each other. However, even in a case where the numbers of bearing holes formed at two sides of the intermediate region of the piston are different from each other, the bearing holes and the gas through holes may be formed in the same manner as in the aforementioned embodiment.

Figure 20:
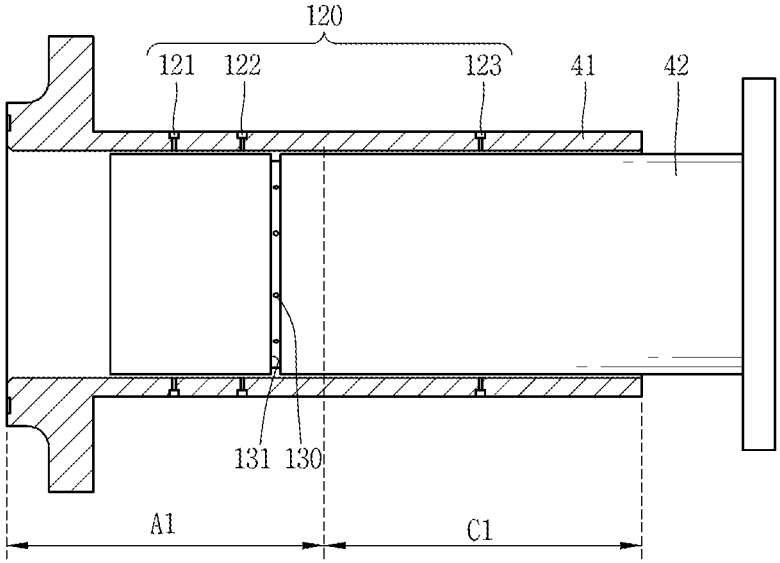
FIG. 20 illustrates another embodiment of an arrangement of bearing holes in the fluid bearing shown in FIG. 3.
Figure 21:
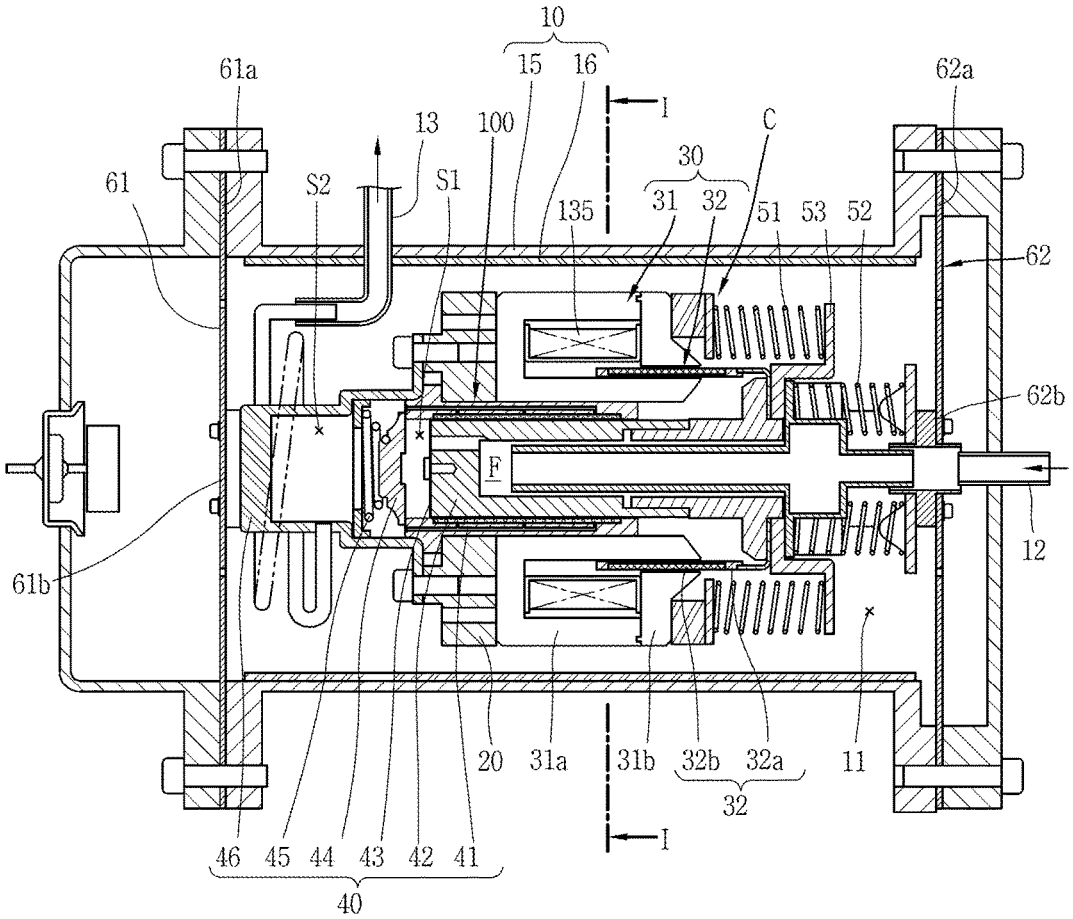
FIG. 21 is a longitudinal sectional view of another embodiment of a casing of a reciprocating compressor, in accordance with an embodiment as broadly described herein.
Figure 22:
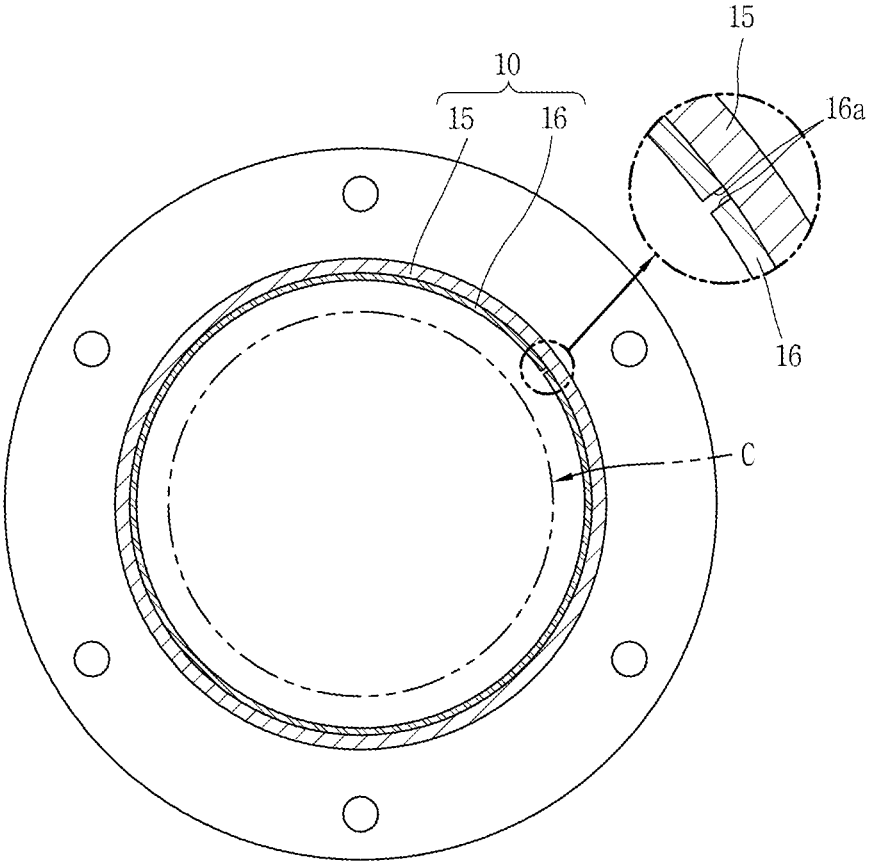
FIG. 22 is a sectional view taken along line "I-I" of FIG. 21.

For instance, as shown in FIG. 20, even in a case where two rows of bearing holes are formed at a front side of the piston and one row of bearing holes are formed at a rear side of the piston, the bearing holes may be formed so that a total sectional area of bearing holes formed at a lower part of the cylinder is larger than that of bearing holes formed at an upper part of the cylinder.

The reciprocating compressor in this embodiment may have the same configuration as the reciprocating compressors in the aforementioned embodiments except that, in this embodiment, bearing holes of a larger number of rows may be arranged at the front side of the piston where a pressure change is relatively great. When so configured, gas introduction into some bearing holes may be stopped due to a low pressure difference between two ends of the bearing holes. In some cases, even if gas leaks to the compression space, etc., gas may be introduced to other bearing holes and thus the piston may be stably supported.

In the aforementioned embodiments, the compressor body (CB) may be fixedly—installed at an inner circumferential surface of the casing 10. Although not shown, the compressor body (CB) may be elastically supported at the casing 10 by, for example, an additional supporting spring such as a plate spring, to attenuate vibration noise. However, the supporting spring alone does not necessarily attenuate vibration applied to the casing 10 from outside, or vibration generated from inside of the casing 10. In this embodiment, for effective attenuation of vibration noise, the casing 10 may have a double shell structure, so that frictional damping may be performed between the shells, and a noise insulating layer may be formed between the shells.

For instance, as shown in FIGS. 21 to 25, the casing 10 may include an outer shell 15 and an inner shell 16. The aforementioned compressor body (C) including the reciprocating motor may be installed at the inner shell 16 and supported by supporting springs 61 and 62.

The outer shell 15 may be formed so that its inner space 11 may be sealed as a plurality of components coupled to each other. The inner shell 16 may have a 'C'-shaped section having cut-out portions 16*a* at two ends thereof in a circumferential direction, so as to be fixed to the outer shell 15 while being elastically supported. The inner shell 16 may be formed of a thin steel plate having a thickness corresponding to about ⅕~⅐ the outer shell 15 having a prescribed thickness for providing an appropriate sealing force.

The inner shell 16 may be formed of a non-magnetic substance such as aluminum or plastic having relatively high strength, not a magnetic substance such as a steel plate, so that a magnetic force generated from the reciprocating motor 30 does not leak through the casing 10. Alternatively, the inner shell 16 may be formed of a non-magnetic substance rather than aluminum or plastic. However, the inner shell 16 may be formed of a heavy non-magnetic substance for effective attenuation of vibration.

Figure 23:
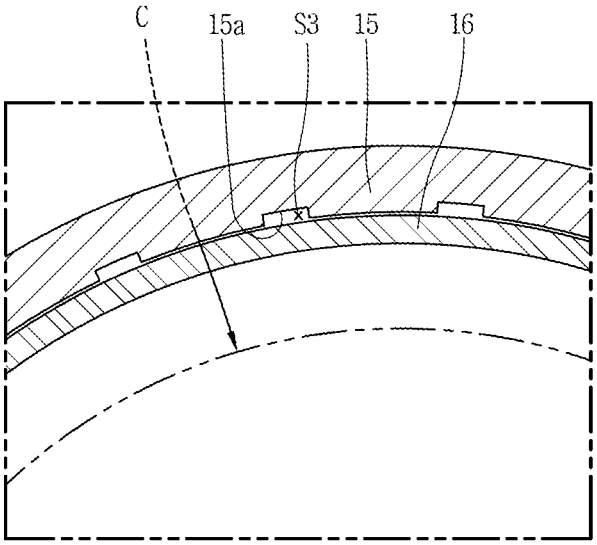
FIGS. 23 and 24 are sectional views of other embodiments of an external shell and an inner shell of the reciprocating compressor shown in FIG. 21.
Figure 24:
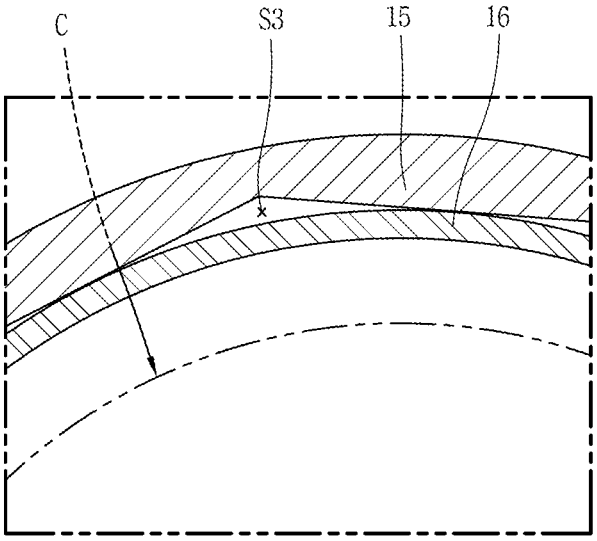

Even if an inner circumferential surface of the outer shell 15 has a cylindrical shape, a micro space portion, i.e., a noise insulating layer may be formed between an inner circumferential surface of the outer shell 15 and an outer circumferential surface of the inner shell 16. However, as shown in FIG. 23, grooves 15*a* may be formed on the inner circumferential surface of the outer shell 15, so that a noise insulating layer (S3) having a prescribed depth may be formed at the inner circumferential surface of the outer shell 15. Alternatively, as shown in FIG. 24, the outer shell 15 may have a polygonal section or a flower petal section having alternating curves. The noise insulating layer (S3) may be formed even if the outer circumferential surface of the inner shell 16 has a polygonal section or a flower petal section.

Figure 25:
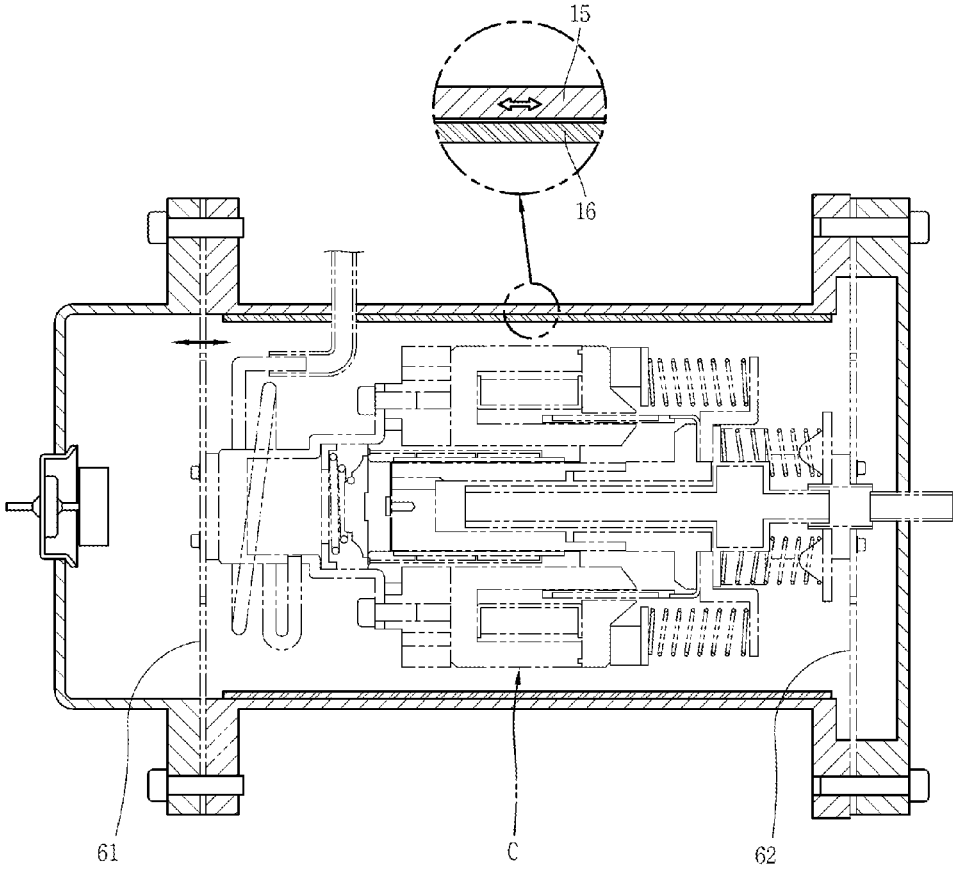
FIG. 25 is a schematic view for explaining a vibration attenuating effect between an external shell and an inner shell of the reciprocating compressor shown in FIG. 21.

In the reciprocating compressor according to this embodiment, even if vibrations generated from inside of the casing 10 or applied from outside are transmitted to the outer shell 15 or the inner shell 16, the vibrations may be attenuated by friction between the outer shell 15 and the inner shell 16, as shown in FIG. 25. Further, as the noise insulating layer (S3) is formed between the outer shell 15 and the inner shell 16, vibration noise may be reduced while passing through the noise insulating layer (S3). As a result, overall vibration noise generated by the reciprocating compressor may be attenuated. Especially, at the noise insulating layer (S3), noise of a high frequency band due to very small vibrations may be attenuated more effectively.

An air layer may be formed at the noise insulating layer (S3). Alternatively, a buffer 17 may be inserted into the noise insulating layer (S3). The buffer may be formed of a material, such as a polymer compound, having a strength lower than that of the outer shell 15 or the inner shell 16. The buffer may be thermally-treated at a high temperature, and then hardened.

Figure 26:
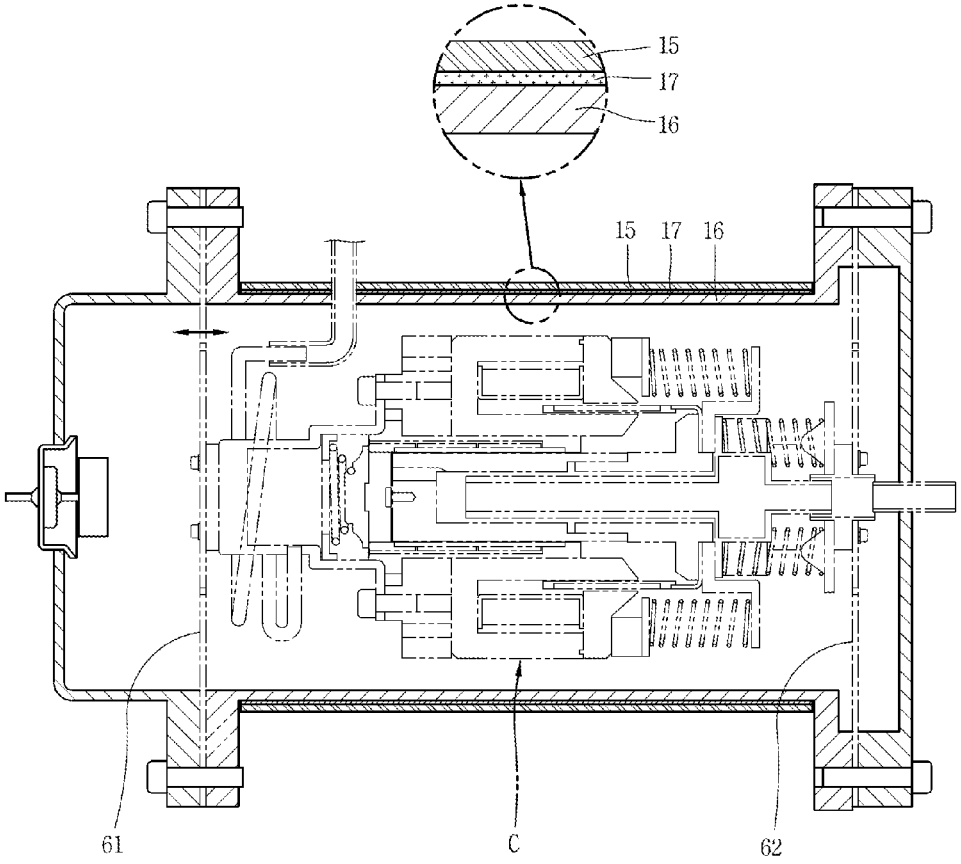
FIG. 26 is a longitudinal sectional view of another embodiment of a casing of the reciprocating compressor shown in FIG. 21.

In the aforementioned embodiment, the outer shell 15 is formed as a sealed type, and the inner shell 16 is formed as an open type. However, in some cases, as shown in FIG. 26, the inner shell 16 may be formed as a sealed type, and the outer shell 15 may be formed as an open type.

In a case where the inner shell 16 is formed as a sealed type and the outer shell 15 is formed as an open type, the compressor body (C), etc. may be assembled to inside of the inner shell 16, and then the outer shell 15 may be assembled to an outer circumferential surface of the inner shell 16. This may facilitate assembly processes of the casing 10 having such a double structure.

A reciprocating compressor is provided that is capable of reducing fabrication costs and enhancing reliability by stably supporting a throughout an entire region of the piston's reciprocating motion, thus enhancing efficiency of the reciprocating compressor, without controlling bearing holes as the piston performs the reciprocating motion.

A reciprocating compressor is provided having enhanced performance due to stably supporting a piston in a radial direction (horizontal direction), and due to use of a fluid bearing.

A reciprocating compressor is provided having an enhanced bearing effect due to smoothly supplying gas into a space between a cylinder and a piston, even if a pressure inside a compression space and a bearing pressure become equal to each other as the piston moves to a top dead point.

A reciprocating compressor is provided that is capable of effectively attenuating vibrations applied to a shell from outside or generated from inside of the shell.

A reciprocating as embodied and broadly described herein may include a reciprocating motor installed at an inner space of a casing, and having a mover which performs a reciprocating motion, a cylinder having a cylinder side bearing surface on an inner circumferential surface thereof, and forming a compression space by part of the cylinder side bearing surface, a piston having a piston side bearing surface on an outer circumferential surface thereof, and having a suction channel penetratingly-formed thereat in a direction of a reciprocating motion, a suction valve coupled to a front end of the piston, and configured to open and close the suction channel, a discharge valve coupled to a front end of the cylinder, and configured to open and close the compression space, and bearing holes penetratingly-formed at the cylinder side bearing surface such that gas discharged from the compression space is supplied to a space between the cylinder side bearing surface and the piston side bearing surface, wherein if the piston is positioned at a point where the compression space is maximized, bearing holes of a row closest to the compression space are positioned between two ends of the piston.

The number of rows of the bearing holes disposed at one side based on a central part of the piston side bearing surface in a lengthwise direction, may be the same as the number of rows disposed at another side.

The numbers of rows of the bearing holes disposed at one side based on a central part of the piston side bearing surface in a lengthwise direction, may be different from the number of rows disposed at another side.

The bearing holes may be formed such that bearing holes arranged at a lower region of the cylinder have a larger total sectional area than those arranged at an upper region of the cylinder.

One or more gas through holes may be formed at the piston so as to penetrate the piston side bearing surface and the suction channel.

The casing may include an outer shell and an inner shell.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

a casing;

a reciprocating motor installed in an inner space of the casing, and having a mover that reciprocates; and a cylinder having a cylinder side bearing surface formed on an inner circumferential surface thereof, and forming a compression space at the cylinder side bearing surface;

a piston having a piston side bearing surface formed on an outer circumferential surface thereof, and having a suction channel that penetrates the piston in a reciprocating direction;

a suction valve coupled to a front end of the piston and configured to open and close the suction channel;

a discharge valve coupled to a front end of the cylinder and configured to open and close the compression space; and bearing holes that guide gas discharged from the compression space to a space between the cylinder side bearing surface and the piston side bearing surface, wherein the casing includes an outer shell and an inner shell, wherein the outer shell and the inner shell are spaced from each other by a predetermined gap to form a space portion therebetween, wherein a supporting spring is coupled between the outer shell and a compression part including the reciprocating motor, the cylinder and the piston, wherein the inner shell and the compression part are separated from each other, wherein the inner shell has a 'C'-shaped section having cut-out portions at two ends thereof in a circumferential direction, and elastically supported to the outer shell, so as to slidably contact the outer shell for frictional damping, and wherein at least one groove having a predetermined width and depth is formed on the inner circumferential surface of the outer shell or the outer circumferential surface of the inner shell, such that the space portion is formed.

2. The reciprocating compressor of claim 1, wherein a buffer formed of a different material from the outer shell or the inner shell is provided at the space portion.

3. A reciprocating compressor, comprising:

a casing;

a reciprocating motor installed in an inner space of the casing, and having a mover that reciprocates; and a cylinder having a cylinder side bearing surface formed on an inner circumferential surface thereof, and forming a compression space at the cylinder side bearing surface;

a piston having a piston side bearing surface formed on an outer circumferential surface thereof, and having a suction channel that penetrates the piston in a reciprocating direction;

a suction valve coupled to a front end of the piston and configured to open and close the suction channel;

a discharge valve coupled to a front end of the cylinder and configured to open and close the compression space; and bearing holes that guide gas discharged from the compression space to a space between the cylinder side bearing surface and the piston side bearing surface, wherein the casing includes an outer shell and an inner shell, wherein at least one of the outer shell or the inner shell is formed as a non-magnetic substance, wherein a supporting spring is coupled between the outer shell and a compression part including the reciprocating motor, the cylinder and the piston, wherein the inner shell and the compression part are separated from each other, and wherein the inner shell has a 'C'-shaped section having cut-out portions at two ends thereof in a circumferential direction, and elastically supported to the outer shell, so as to slidably contact the outer shell for frictional damping.

* * * * *